US005537816A

United States Patent [19]

Ridgway et al.

[11] Patent Number: 5,537,816

[45] Date of Patent: Jul. 23, 1996

[54] ENGINE AIR/FUEL CONTROL RESPONSIVE TO CATALYST WINDOW LOCATOR

[75] Inventors: Robert W. Ridgway, Royal Oak; Michael P. Falandino, Wyandotte; Thomas S. Gee, Canton, all of Mich.

[73] Assignee: Ford Motor Company, Dearborn, Mich.

[21] Appl. No.: 398,835

[22] Filed: Mar. 6, 1995

[51] Int. Cl.[6] ..... F02D 41/14

[52] U.S. Cl. ..... 60/274; 60/285

[58] Field of Search ..... 60/274, 276, 285

[56] References Cited

U.S. PATENT DOCUMENTS 4,953,351 9/1990 Motz et al. ..... 60/285

5,115,639 5/1992 Gopp ..... 60/274

5,438,827 8/1995 Ohuchi et al. ..... 60/285

*Primary Examiner*—Leonard E. Heyman

*Attorney, Agent, or Firm*—Allan J. Lippa; Roger L. May

[57] ABSTRACT

An engine air/fuel controller (12) is responsive to a two-state exhaust gas oxygen sensor (16) positioned upstream of a three-way catalytic converter (20) and a proportional exhaust gas oxygen sensor (24) positioned downstream of the catalytic converter. A base fuel signal is trimmed by a feedback variable derived by integrating (402–428) the upstream (16) sensor output. The feedback variable is biased towards leaner air/fuel ratios when a distribution of the downstream sensor output amplitudes has a peak value indicating a rich air/fuel ratio. And the feedback variable is biased towards richer air/fuel ratios when the downstream sensor output distribution has a peak value indicating a lean air/fuel ratio (320–396).

17 Claims, 6 Drawing Sheets

ENGINE AIR/FUEL CONTROL RESPONSIVE TO CATALYST WINDOW LOCATOR

1. FIELD OF THE INVENTION

The field of the invention relates to controlling the air/fuel ratio of an internal combustion engine coupled to a catalytic converter.

BACKGROUND OF THE INVENTION

Air/fuel control systems are known which are responsive to two-state (rich or lean) exhaust gas oxygen sensors positioned upstream of conventional three-way (HC, CO, NOx) catalytic converters. A feedback variable derived by integrating the upstream sensor output adjusts the engine air/fuel ratio in an attempt to maintain stoichiometric combustion. However, aging and manufacturing tolerances of the sensors may result in air/fuel operation at values other than stoichiometry.

In an effort to maintain the engine air/fuel ratio at stoichiometry, either the feedback variable or the upstream sensor output are biased in response to an output of another exhaust gas oxygen sensor positioned downstream of the converter. An example of such an approach is disclosed in U.S. Pat. No. 5,115,639.

The inventors herein have recognized numerous problems with the above approaches. For example, despite having a downstream exhaust gas oxygen sensor, the engine's air/fuel ratio may still not be maintained within the peak efficiency window of the catalytic converter. Such misalignment in operation may be caused by factors such as aging or variations in manufacturing tolerances of either the exhaust gas oxygen sensors or the catalytic converter.

SUMMARY OF THE INVENTION

An object of the invention herein is to maintain engine air/fuel operation within the peak efficiency window of a catalytic converter.

The above object is achieved, and problems of prior art approaches overcome, by providing both a method and a air/fuel control system for an engine having an exhaust coupled to a three-way catalytic converter. In one particular aspect of the invention, the control method comprises the steps of: providing a base fuel signal related to quantity of air inducted into the engine; generating a fuel correction signal in response to an output of the first exhaust gas oxygen sensor for correcting the fuel base signal to provide a desired engine air/fuel ratio; generating a bias signal for biasing the fuel correction signal towards a leaner air/fuel ratio when a distribution of the second sensor output amplitudes has a peak value indicating a rich air/fuel ratio and for biasing the fuel correction towards a richer air/fuel ratio when the second sensor output distribution has a peak value indicating a lean air/fuel ratio; and delivering fuel to the engine in proportion to the base fuel signal corrected by the fuel correction signal biased by the bias signal.

An advantage of the above aspect of the invention is that engine air/fuel ratio is maintained within the peak efficiency window of the three-way catalytic converter regardless of the accuracy of the proportional exhaust gas oxygen sensor. Another advantage of the above aspect to the invention, is that the switch point in the output of the upstream sensor is biased so that it is always in alignment with the peak efficiency window of the three-way catalytic converter.

BRIEF DESCRIPTION OF THE DRAWINGS

The above object and advantages of the invention will be more clearly understood by reading an example of an embodiment in which the invention is used to advantage with reference to the attached drawings wherein.

DESCRIPTION OF AN EMBODIMENT

Figure 1:
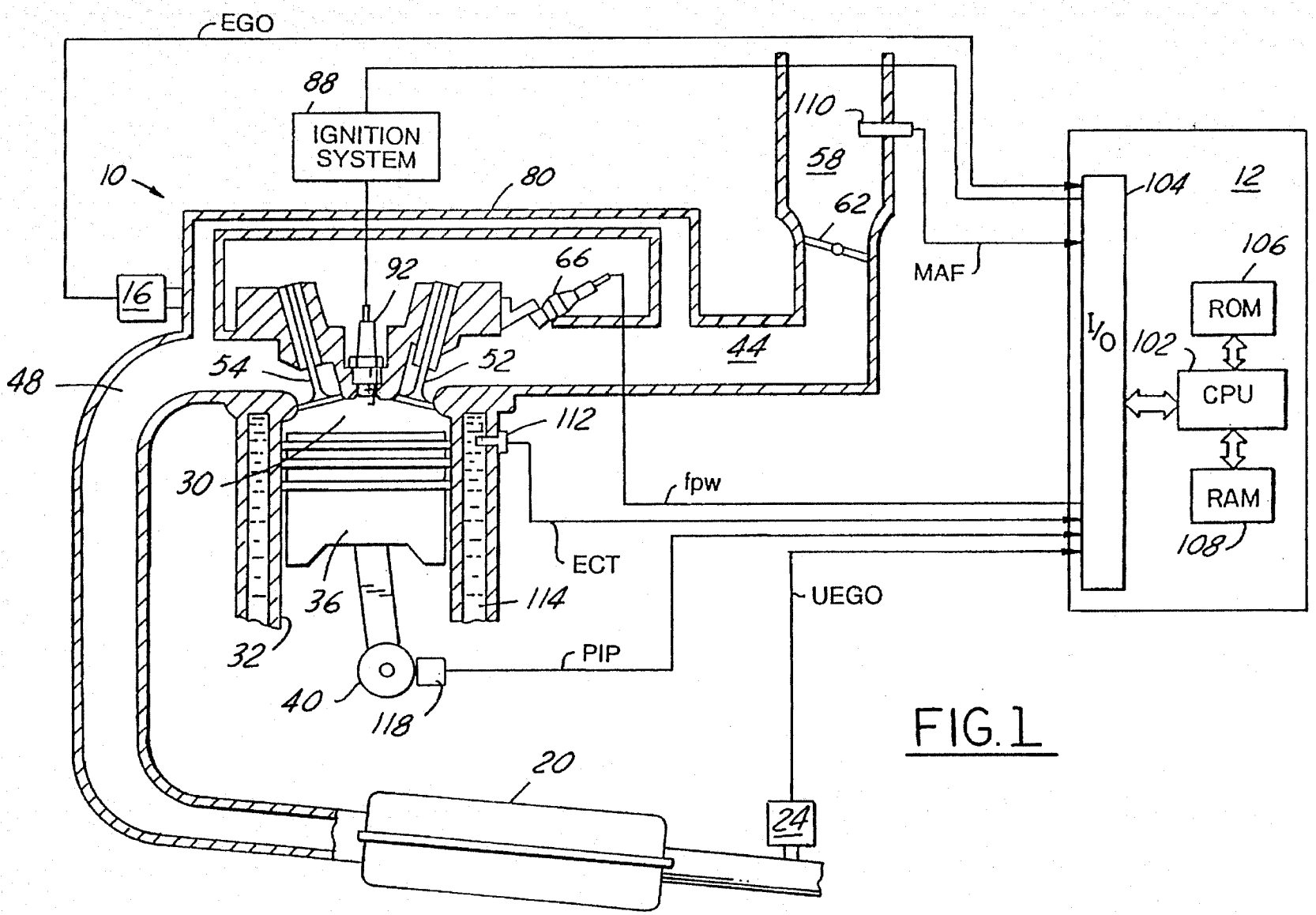
FIG. 1 is a block diagram of an embodiment where the invention is used to advantage.

Internal combustion engine 10 comprising a plurality of cylinders, one cylinder of which is shown in FIG. 1, is controlled by electronic engine controller 12. In general terms which are described later herein, controller 12 controls engine air/fuel ratio in response to feedback variable FV derived from two-state signal EGOS which is derived from the output of exhaust gas oxygen sensor 16 as described in greater detail later herein with particular reference to FIG. 5 (step 402). Concurrently, as described later herein with particular reference to FIGS. 3A, 3B, and 4, controller 12 provides an air/fuel bias in response to signal processing the output of proportional exhaust gas oxygen sensor (UEGO) 24. Sensor 24 is a conventional proportion UEGO sensor having an output corresponding to the air/fuel ratio of engine 10. As described later herein, the air/fuel biasing forces engine air/fuel operation to be within the peak efficiency window of three-way (HC, CO and $NO_x$) catalytic converter 20.

Continuing with FIG. 1, engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Intake manifold 44 is also shown having fuel injector 66 coupled thereto for delivering liquid fuel in proportion to the pulse width of signal FPW from controller 12. Fuel is delivered to fuel injector 66 by a conventional fuel system (not shown) including a fuel tank, fuel pump, and fuel rail (not shown).

Conventional distributorless ignition system 88 provides ignition spark to combustion chamber 30 via spark plug 92 in response to controller 12. Two-state exhaust gas oxygen sensor 16 is shown coupled to exhaust manifold 48 upstream of catalytic converter 20. Sensor 16 provides signal EGO to controller 12 which converts signal EGO into two-state signal EGOS. A high voltage state of signal EGOS indicates exhaust gases are rich of a reference air/fuel ratio and a low voltage state of converted signal EGO indicates exhaust gases are lean of the reference air/fuel ratio. Typically, the reference air/fuel ratio or switch point of EGO sensor 16 should be at stoichiometry. And stoichiometry should fall within the peak efficiency window of the average catalytic converter. However, due to manufacturing processes and component aging, the switch point of EGO sensor 16 may not be at stoichiometry. Further, the peak efficiency window of converter 20 may not be at stoichiometry. Such misalignments are corrected by the air/fuel biasing described later herein.

Controller 12 is shown in FIG. 1 as a conventional microcomputer including: microprocessor unit 102, input/output ports 104, read only memory 106, random access memory 108, and a conventional data bus. Controller 12 is shown receiving various signals from sensors coupled to engine 10, in addition to those signals previously discussed, including: measurements of inducted mass air flow (MAF) from mass air flow sensor 110 coupled to throttle body 58; engine coolant temperature (ECT) from temperature sensor 112 coupled to cooling sleeve 114; a measurement of manifold pressure (MAP) from manifold pressure sensor 116 coupled to intake manifold 44; and a profile ignition pickup signal (PIP) from Hall effect sensor 118 coupled to crankshaft 40.

Figure 2:
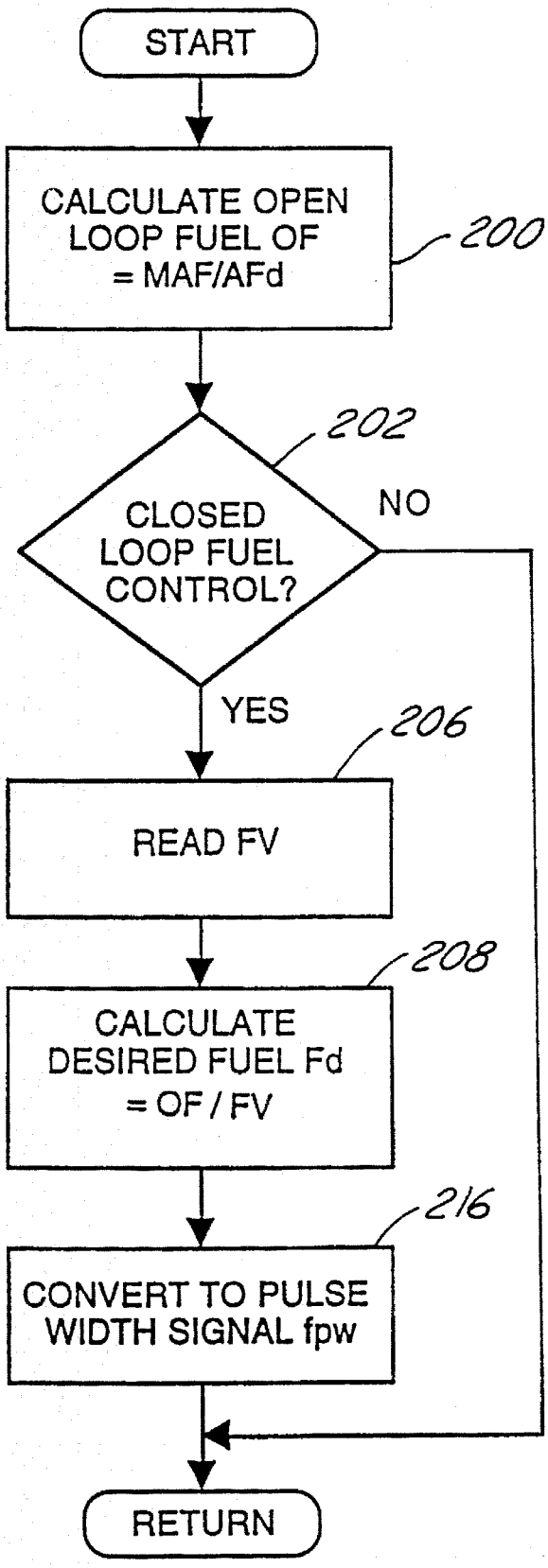
FIG. 2 is a high level flow chart of various operations performed by a portion of the embodiment shown in FIG. 1.

The liquid fuel delivery routine executed by controller 12 for controlling engine 10 is now described beginning with reference to the flowchart shown in FIG. 2. An open loop calculation of desired liquid fuel (signal OF) is calculated in step 300. More specifically, the measurement of inducted mass airflow (MAF) from sensor 110 is divided by a desired air/fuel ratio (AFd) which, in this example, is correlated with stoichiometric combustion. A determination is made that closed loop or feedback control is desired (step 302), by monitoring engine operating parameters such as engine coolant temperature ECT. Desired fuel quantity, or fuel command, for delivering fuel to engine 10 is generated by dividing feedback variable FV into the previously generated open loop calculation of desired fuel (signal OF) as shown in step 308. Fuel command or desired fuel signal Fd is then converted to pulse width signal fpw (step 316) for actuating fuel injector 66.

A subroutine will be described with particular reference to FIG. 4 for biasing feedback variable FV so that engine air/fuel operation is maintained within the peak efficiency window of converter 20. To better understand the subroutine to be described with reference to FIG. 4, it is useful to first review the waveforms presented in FIGS. 3A and 3B.

Figure 3A:
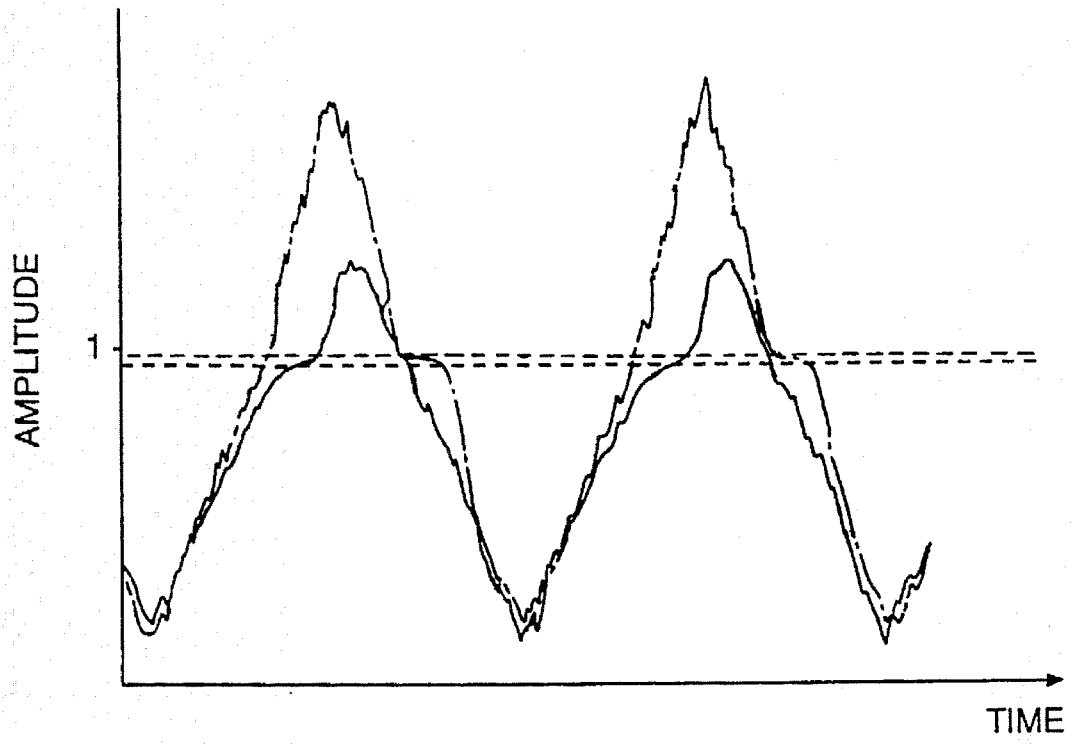
FIGS. 3A and 3B are graphical representations of the various electrical signals generated by a portion of the embodiment shown in FIG. 1.

FIG. 3A shows the output waveforms from EGO sensor 16 (solid line) and proportional UEGO sensor 24 (dashed lines) for a hypothetical operation in which the engine air/fuel ratio is swept through an air/fuel range to cause air/fuel excursions between rich and lean at the output of converter 20. Such sweeping would occur during open loop air/fuel control. The inventors herein have recognized that the output of UEGO sensor 24 partially flattens or plateaus when air/fuel operation is within the peak efficiency window of catalytic converter 20. Those skilled in the art recognize that the peak efficiency window is the range of air/fuel ratios in which catalytic converter 20 most efficiently removes HC, CO, and $NO_x$. The stoichiometric air/fuel ratio occurs within the peak efficiency window. When exhaust air/fuel ratio is leaner than stoichiometry, oxygen is stored in catalytic converter 20. As the exhaust air/fuel ratio transitions rich to a value within the peak efficiency window of catalytic converter, the stored oxygen combines with the exhaust HC so that the exhaust air/fuel ratio remains relatively flat as long as stored oxygen is available. These plateaus are designated by the dotted lines shown in FIG. 3A. The plateaus are also shown in the example of operation presented in FIG. 3B which illustrates hypothetical operation during closed loop air/fuel control where the air/fuel ratio is initially operating at a value lean of stoichiometry (the control system described later herein with particular reference to FIGS. 4A, 4B, and 5, will eventually force the air/fuel ratio into the peak efficiency window of catalytic converter 20 so that the peaks and plateaus shown in FIG. 3B would then be more random).

Figure 3B:
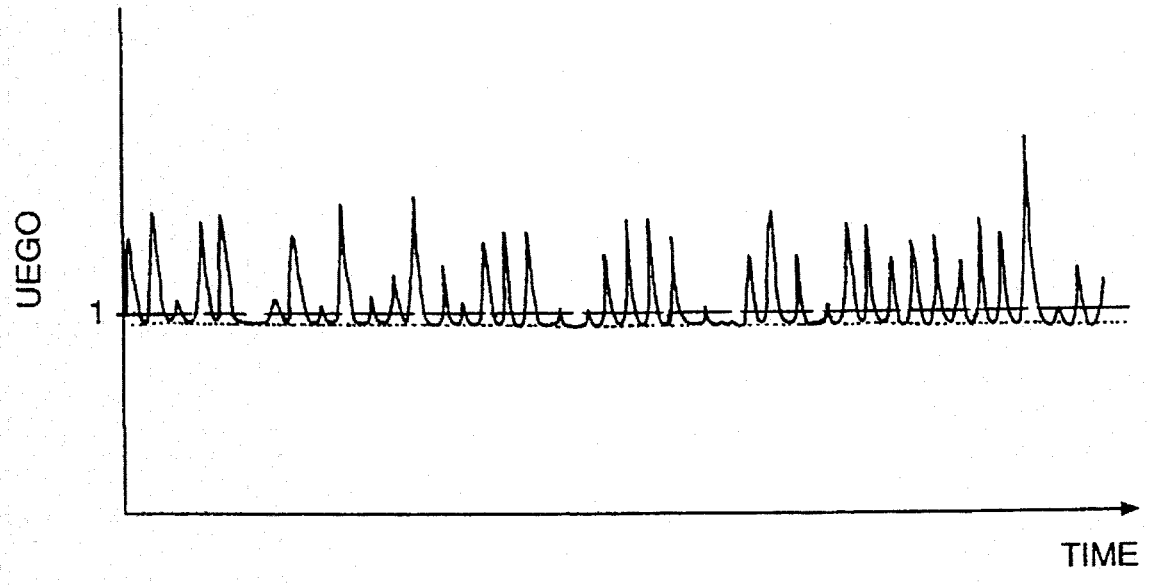

As will be described in greater detail later herein with particular reference to FIG. 4, the flattened portions in the output of UEGO sensor 24 shown in FIG. 3B represent the upper limit of the peak efficiency window of converter 20 (shown by the dotted line in FIG. 3B). The inventors herein have further recognized that proper signal processing of the output of UEGO sensor 24 may identify these flattened areas or plateaus and further identify the peak efficiency window of converter 20 as described below.

Figure 4A:
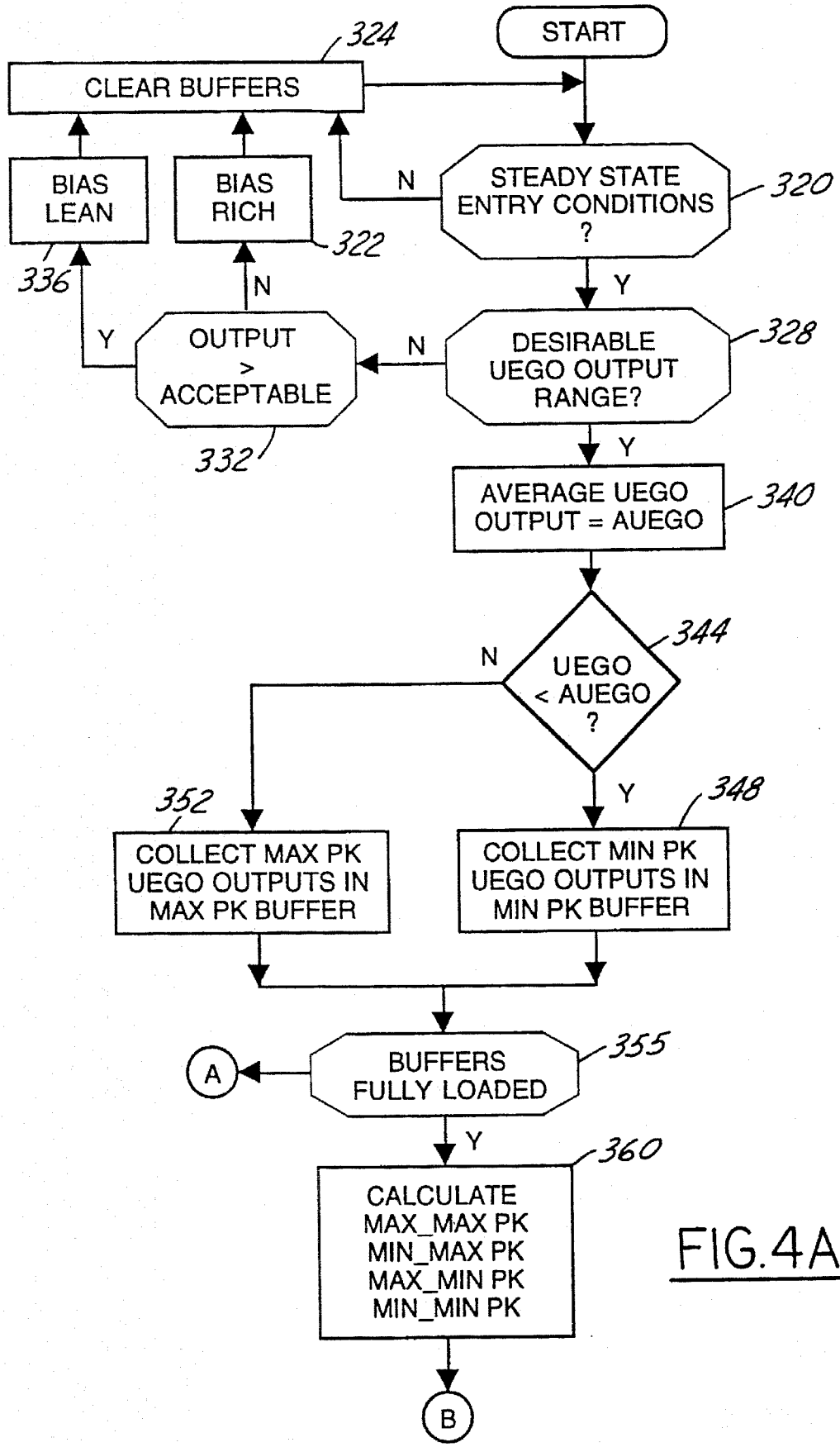
FIGS. 4A–4B and 5 are high-level flow charts of various operations performed by a portion of the embodiment shown in FIG. 1.
Figure 4B:
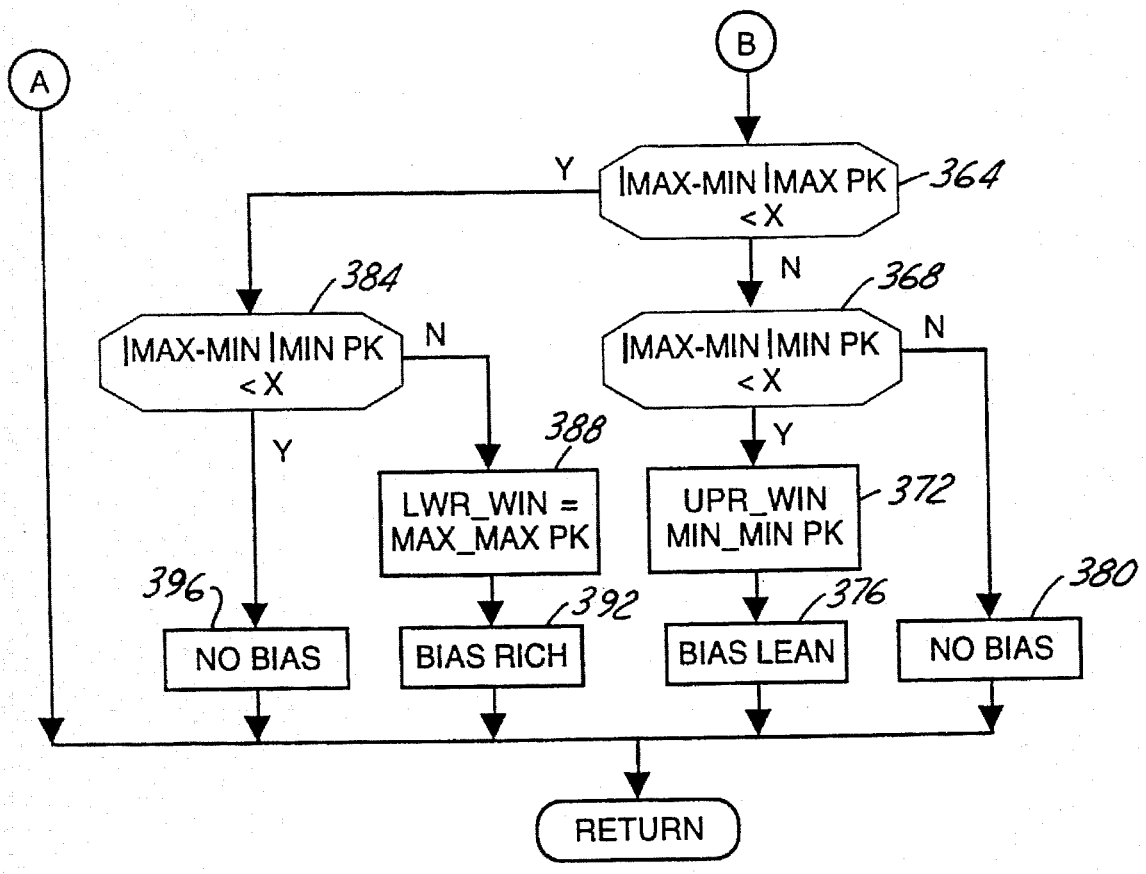

In the subroutine now described with reference to FIGS. 4A–4B, air/fuel rich bias and lean bias signals are generated. As described later herein with particular reference to FIG. 5, these bias signals bias feedback variable FV thereby offsetting or biasing the engines air/fuel ratio in proportion to the amplitude of the appropriate bias signal.

Steady state conditions such as ECT is within a desirable range, engine load within a desirable range, and engine speed within a desirable range are monitored during step 320. During transient operation, the buffer registers associated with this subroutine are cleared (step 324). When steady state conditions are detected (320), the output of UEGO sensor 24 (signal UEGO) is checked to see that it is within a desired output range (328). If signal UEGO is out of range (328), and its output above an acceptable limit (332), a lean bias signal is provided (322). On the other hand, if signal UEGO is out of range (328), and less than the acceptable limits shown in step 332, a rich air/fuel bias is provided in step 336.

When signal UEGO is within a desirable range (328), average UEGO output value AUEGO is generated in step 340. Average UEGO is generated in this particular example as a time weighted average over a calibratable time period. During each sample period, when signal UEGO is less than average value AUEGO (step 344), each peak value of signal UEGO (MINPK) is stored in the minimum peak value (MINPK) buffer (step 348). On the other hand, when signal UEGO is greater than average value AUEGO (344), peak values of signal UEGO (MAXPK) are stored in the maximum peak (MAXPK) buffer as shown in step 352.

When the MAXPK buffer and MINPK buffer are fully loaded (356), the maximum peak value (MAX_MAXPK) and minimum value (MIN_MAXPK) from the MAXPK buffer are determined (360). In addition, the maximum peak value (MAX_MINPK) and minimum peak value (MIN_MINPK) from the MINPK buffer are determined (360).

The above described maximum and minimum peak values are then utilized to determine the upper and lower limits of the catalytic converter's peak efficiency window. More specifically, when the difference between maximum and minimum peak values above average value AUEGO (|MAX–MIN|MAXPK) is greater than predetermined value "X" (364), and the difference between maximum and minimum peak values below average value AUEGO (|MAX–MIN|MINPK) is below predetermined value "X" (368), the upper limit (UPR_WIN) of the converter's peak efficiency window is established (372). The peak efficiency window upper limit (UPR_WIN) is set equal to the minimum peak value of signal UEGO below average value AUEGO (MIN_MINPK) as shown in step 372. A lean bias increment is then provided in step 376.

When the difference between maximum and minimum peak values above average value AUEGO (|MAX–MIN|MAXPK) is greater than predetermined value "X" (364), and when the difference between maximum and minimum peak values below average value AUEGO (|MAX–MIN|MINPK) is greater than predetermined value "X" (368), no change in bias is provided as shown in seep 380.

The lower (i.e. lean) limit of the converter's peak efficiency window and the appropriate air/fuel biasing at such lower limit are now described. When the difference between maximum and minimum peak values above average value AUEGO (|MAX–MIN|MAXPK) is less than predetermined value "X" (364), and the difference between maximum and minimum peak values below average value AUEGO (|MAX–MIN|MINPK) is greater than predetermined value "X" (384), lower window limit LWR_WIN is set equal to the maximum peak value above average value AUEGO (388). A rich air/fuel bias increment is also provided in step 392. On the other hand, when the difference between maximum and minimum peak values above average value AUEGO (|MAX–MIN|MAXPK) is less than predetermined value "X" (364), and the difference between maximum and minimum peak values below average value AUEGO (|MAX–MIN|MINPK) is less than predetermined value "X" (384), no change in air/fuel bias is provided (396).

The air/fuel feedback routine executed by controller 12 to generate fuel feedback variable FV is now described with reference to the flowchart shown in FIG. 5. Signal EGO is read, after determining that closed loop air/fuel control is desired in step 400. During step 402, two-state signal EGOS is generated by comparing signal EGO to a reference value approximately at the mid-point and its peak-to-peak output. Signal EGOS is a two-state signal which indicates air/fuel ratio is rich or lean of a reference air/fuel ratio dependent upon its output state (e.g. 5 volts or 0 volts, respectively).

Under ideal conditions, the switch point between output states of signal EGOS identified as a reference air/fuel ratio which is at stoichiometry. Further, under ideal conditions, the switch point in output states of signal EGOS is aligned with the peak efficiency window of catalytic converter 20. Stated another way, under ideal conditions, both the switch point and output states of signal EGOS and the peak efficiency window of catalytic converter 20 are both at stoichiometry. However, factors such as component aging and variations in manufacturing processes cause a misalignment between the switch point in signal EGOS and the peak efficiency window of the catalytic converter 20. This misalignment is corrected by biasing feedback variable FV as feedback variable FV is generated by the proportional plus integral controller described below. The biasing is responsive to the subroutine previously described with particular reference to FIG. 4.

Figure 5:
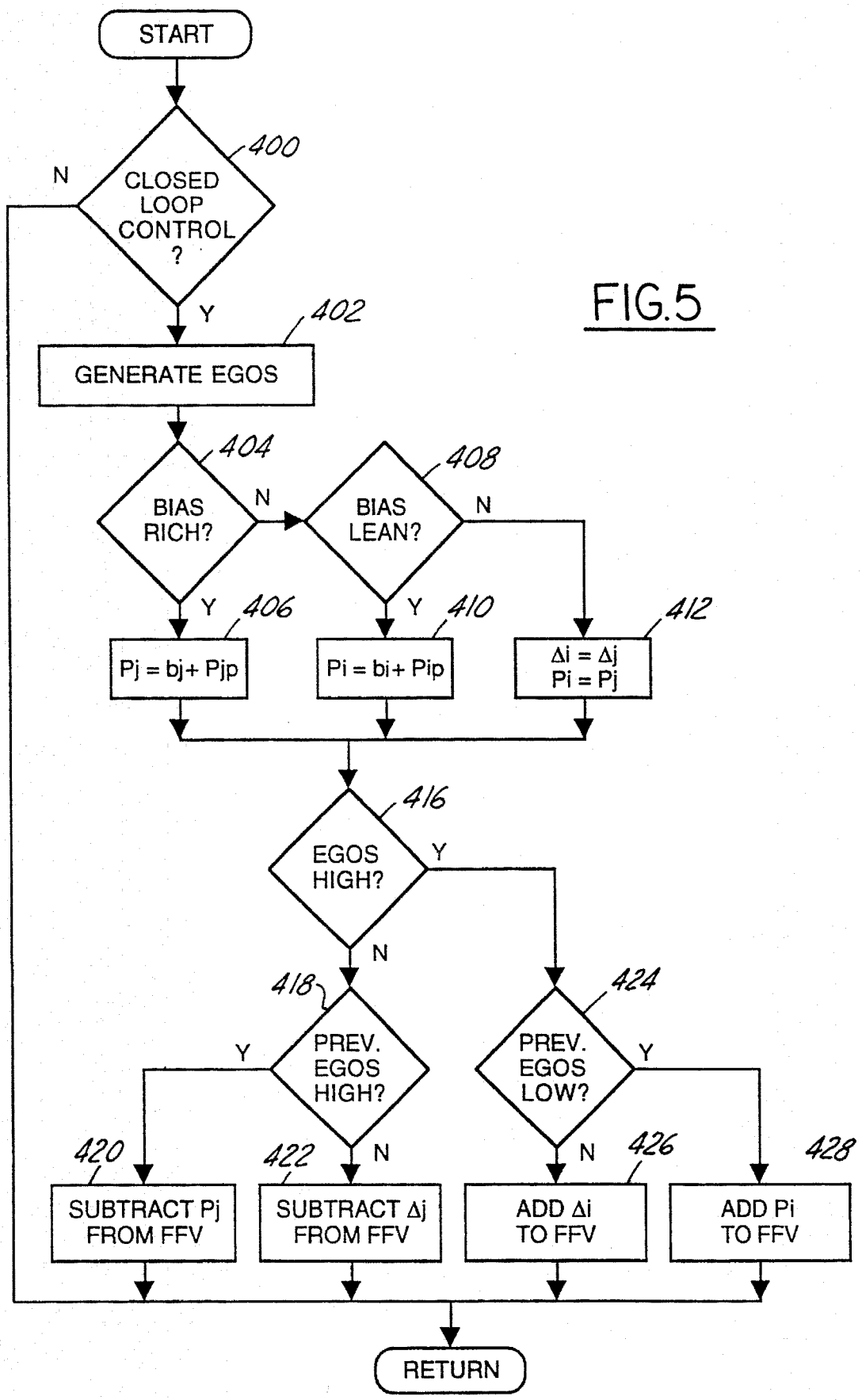

Continuing with FIG. 5, the proportional plus integral feedback controller for generating feedback variable FV and the appropriate biasing of feedback variable FV are now described. Rich bias signal (bj) is generated from a rolling average of the rich bias increments which were provided from the subroutine described in FIG. 4 (404). Proportional term $P_j$ is increased by rich bias signal (bj) with respect to its previous value ($P_{jp}$) as shown in step 406. Proportional term $P_j$ is the proportional term of the PI (proportional plus integral) controller in a direction to cause a rich correction to the engine's air/fuel ratio.

Lean bias signal (bi) is generated from a rolling average of the lean bias increments which are provided from the subroutine described in FIG. 4 (408). Proportional term $P_i$ is increased with lean bias signal (bi) from its previous value $P_{ip}$ (410). Proportional term PI is generated in a direction to cause a lean correction to the engine's air/fuel ratio.

When no bias increment is provided from the subroutine shown in FIG. 4 (404, 408), proportional term $P_i$ is set equal to proportional $P_j$. The integral term or step in both the rich correction direction (Δi) and the integral term in the lean correction direction (Δj) are also set equal.

When signal EGO is low (step 416), but was high during the previous background loop of controller 12 (step 418), preselected proportional term $P_j$ is subtracted from feedback variable FV (step 420). When signal EGO is low (step 416), and was also low during the previous background loop (step 418), preselected integral term Δj, is subtracted from feedback variable FV (step 422).

Similarly, when signal EGOS is high (step 416), and was also high during the previous background loop of controller 12 (step 424), integral term Δj, is added to feedback variable FV (step 426). When signal EGOS is high (step 416), but was low during the previous background loop (step 424), proportional term Pi is added to feedback variable FV (step 428).

In accordance with the above described operation, feedback variable FV is generated from a proportional plus integral controller (PI) responsive to exhaust gas oxygen sensor 16. The integration steps for integrating signal EGO in a direction to cause a lean air/fuel correction are provided by integration steps Δi, and the proportional term for such correction provided by $P_i$. Similarly integral term Δj and proportional term $P_j$ cause rich air/fuel correction.

This concludes a description of an example of operation in which the invention claimed herein is used to advantage. Those skilled in the art will bring to mind many modifications and alterations to the example presented herein without departing from the spirit and scope of the invention. Accordingly, it is intended that the invention be limited only by the following claims.

What is claimed:

1. An air/fuel control method for an engine responsive to first and second exhaust gas oxygen sensors respectively positioned upstream and downstream of a catalytic converter, comprising the steps of:

providing a base fuel signal related to quantity of air inducted into the engine;

generating a bias signal for biasing said fuel correction signal towards a leaner air/fuel ratio when a plurality of the second sensor output amplitudes has a peak value indicating a rich air/fuel ratio and for biasing said fuel correction towards a richer air/fuel ratio when a plurality of said second sensor output amplitude has a peak value indicating a lean air/fuel ratio; and delivering fuel to the engine in proportion to said base fuel signal corrected by said fuel correction signal biased by said bias signal.

2. The method recited in claim 1 wherein said peak value indicating said rich air/fuel ratio is generated by the steps of: computing an average of said distribution of said second sensor output values, determining a maximum and a minimum of said second sensor output values in said distribution above said average; and taking a difference between said maximum and said minimum above said average.

3. The method recited in claim 2 wherein said peak value indicating said lean air/fuel ratio is generated by the steps of: computing an average of said distribution of said second sensor output values, determining a maximum and a minimum of said second sensor output values in said distribution below said average; and taking a difference between said maximum and said minimum below said average.

4. The method recited in claim 3 wherein said lean air/fuel bias is provided when said peak value indicating said rich air/fuel ratio is greater than a preselected value and said peak value indicating said lean air/fuel ratio is lesser than said preselected value.

5. The method recited in claim 4 wherein said rich air/fuel bias is provided when said peak value indicating said rich air/fuel ratio is less than said preselected value and said peak value indicating said lean air/fuel ratio is greater than said preselected value.

6. The method recited in claim 1 wherein said step of providing said base fuel signal is further responsive to a value representative of said desired air/fuel ratio.

7. The method recited in claim 1 wherein said step of providing said fuel correction signal is further responsive to an integration of said first sensor output.

8. The method recited in claim 1 wherein said first exhaust gas oxygen sensor output has first and second output states when engine air/fuel ratio is respectively rich or lean of said desired air/fuel ratio.

9. The method recited in claim 4 wherein said second sensor output amplitude is proportional to engine air/fuel ratio.

10. An air/fuel control method for an engine responsive to first and second exhaust gas oxygen sensors respectively positioned upstream and downstream of a catalytic converter, comprising the steps of:

integrating an output of the first exhaust gas oxygen sensor to provide a fuel correction signal;

providing a fuel signal related to quantity of air inducted into the engine and a desired air/fuel ratio and said fuel correction signal;

computing an average of second sensor values from said second sensor;

generating a first difference signal between maximum and minimum of said second sensor values above said average and generating a second difference signal between maximum and minimum of said second sensor values below said average;

offsetting said fuel signal towards a leaner air/fuel ratio when said first difference signal exceeds a preselected value and said second difference signal is less than said preselected value; and delivering fuel to the engine in proportion to said fuel signal as offset by said offsetting step.

11. The method recited in claim 10 further comprising a step of offsetting said fuel signal towards a richer air/fuel ratio when said second difference signal exceeds said preselected value and said first difference signal is less than said preselected value.

12. The method recited in claim 11 wherein said offsetting steps comprise a step of biasing said fuel correction signal.

13. The method recited in claim 11 wherein said first exhaust gas oxygen sensor output has first and second output states when engine air/fuel ratio is respectively rich or lean of said desired air/fuel ratio.

14. The method recited in claim 11 wherein said second sensor output amplitude is proportional to engine air/fuel ratio.

15. An air/fuel control system for an engine having an exhaust coupled to a three way catalytic converter, comprising:

a proportional exhaust gas oxygen sensor having an output proportional to the engine's air/fuel ratio;

a fuel controller providing a fuel signal related to quantity of air inducted into the engine and a desired air/fuel ratio; and said fuel controller offsetting said fuel signal towards a leaner air/fuel ratio when a plurality of output amplitudes from said proportional exhaust gas oxygen sensor has a peak value indicating a rich air/fuel ratio and offsetting said fuel signal towards a richer air/fuel ratio when said plurality of output amplitudes from said proportional gas oxygen sensor has a peak value indicating a lean air/fuel ratio.

16. The air/fuel control system recited in claim 15 further comprising an upstream exhaust gas oxygen sensor positioned upstream of the converter and a feedback controller providing a fuel correction signal for correcting said fuel signal by integrating an output of the first exhaust gas oxygen sensor.

17. The air/fuel control system recited in claim 16 wherein said fuel controller offsets said fuel signal by biasing said fuel correction signal.

* * * * *